US008099014B2

(12) United States Patent
Kawahito et al.

(10) Patent No.: US 8,099,014 B2
(45) Date of Patent: Jan. 17, 2012

(54) IMAGE FORMING APPARATUS

(75) Inventors: Hiroshi Kawahito, Nara (JP); Masanobu Deguchi, Kashiba (JP); Yasuyuki Ishiguro, Higashiosaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 508 days.

(21) Appl. No.: 12/335,866

(22) Filed: Dec. 16, 2008

(65) Prior Publication Data

US 2009/0169240 A1 Jul. 2, 2009

(30) Foreign Application Priority Data

Dec. 27, 2007 (JP) ..... 2007-335482

(51) Int. Cl.
*G03G 15/08* (2006.01)

(52) U.S. Cl. ..... 399/106; 399/103

(58) Field of Classification Search ..... 399/98, 399/102–106
See application file for complete search history.

(56) References Cited

U.S. PATENT DOCUMENTS 5,229,824 A * 7/1993 Tsusaka et al. ..... 399/262
6,438,345 B1 8/2002 Ban et al.
6,484,000 B1 11/2002 Ogawa et al.
6,496,667 B2 12/2002 Shiratori et al.

FOREIGN PATENT DOCUMENTS

| | | |
|---|---|---|
| CN | 1209576 A | 3/1999 |
| CN | 1269533 A | 10/2000 |
| JP | 04-184463 | 7/1992 |
| JP | 08-334962 | 12/1996 |
| JP | 2000-035711 | 2/2000 |
| JP | 2001-281996 | 10/2001 |
| JP | 2003-107977 | 4/2003 |
| JP | 2005-084154 | 3/2005 |

* cited by examiner

*Primary Examiner* — David Gray
*Assistant Examiner* — Gregory H Curran
(74) *Attorney, Agent, or Firm* — Renner, Otto, Boisselle & Sklar, LLP

(57) ABSTRACT

A developing device includes a developer reservoir having developer stored therein, a developing roller for carrying developer, a sealing member which is brought into close contact with the developer portion so as to cover a communication port in communication with inside of the developer reservoir, and a sealing passing member for passing the sealing member peeled off the developer reservoir, wherein the sealing member is peeled off the developer reservoir to open the communication port and the sealing passing member has an opening with an approximately elliptical shape, through which the sealing member passes.

6 Claims, 6 Drawing Sheets

IMAGE FORMING APPARATUS

This Nonprovisional application claims priority under 35 U.S.C. §119(a) on Patent Application No. 2007-335482 filed in Japan on 27 Dec. 2007, the entire contents of which are hereby incorporated by reference.

BACKGROUND OF THE INVENTION

1. Field of the Invention

The present invention relates to a developing device, an image forming apparatus using the same, and a method for peeling off a sealing member of the developing device, specifically to a developing device integrally configured by unitizing components such as a developer reservoir having developer stored therein and a developing roller, which is configured so as not to cause leakage of developer and contamination in the device during shipment thereof, an image forming apparatus using the same, and a method for peeling off a sealing member of the developing device.

2. Description of the Prior Art

Recently, an image forming apparatus such as a copier and a facsimile device using developer has employed a developing device for visualizing an electrostatic latent image formed on a photoreceptor drum, which is configured by integrally unitizing components such as a developer reservoir having developer stored therein and a developing roller.

Conventionally, a developing device having developer stored therein has used a sealing member, a sealing cover or the like to seal a communication port in communication with the interior of a developer reservoir so as not to cause leakage of developer stored in the developer reservoir during attaching operation to the device, shipment, and movement, or so as to shut out moisture from entering in developer.

As a method for sealing the communication port of the developer reservoir, it is general to attach a sealing member such as a heat seal on a part of the developer reservoir to seal the communication port, because the operation of which is relatively easily performed at a low cost.

However, the sealing member is pulled outside when removing the sealing member from the developer reservoir, thus posing a problem that a surface to which developer (toner) is adhered is taken out to the outside so that the developer adhering to the sealing member contaminates a hand or clothes of a worker.

Hence, various methods for removing a sealing member without causing contamination by toner have been conventionally considered.

For example, a toner cartridge having toner stored therein and used for a developing device such as a copier is proposed, wherein an opening for supplying toner to the developing device is sealed by a sealing member and one end of the sealing member is wound by seal wind-up means (cf., Patent Literature 1: Japanese Patent Application Laid-Open Hei 8 No. 334692).

Furthermore, as another system a cartridge-type developing device is proposed, wherein an opening of a toner container for supplying toner to the developing device is sealed by a sealing member and plural driving systems of the developing device are disposed divisionally on longitudinal both ends of the developing roller to obtain, from each of the divisionally disposed driving systems, driving for an automatic wind-up mechanism for winding up the sealing member (cf., Patent Literature 2: Japanese Patent Application Laid-Open No. 2001-281996).

However, in the conventional technology, the configuration in the Patent Literature 1 needs a handle for winding up the sealing member and a driving system for driving the same in addition, thus posing a problem of increasing the number of components in the device and the cost as well as making the configuration of the cartridge itself large-sized.

Furthermore, in the configuration of the Patent Literature 2, by divisionally disposing the driving systems of the developing device, only the side where the driving systems are provided does not protrude to the outside, thus making it possible to provide the configuration without increasing a size of an exterior cover, but the automatic winding-up mechanism for winding up the sealing member needs a space to be installed, thus posing a problem that the corresponding part protrudes to the outside to enlarge the developing device.

In this way, a conventional method for removing a sealing member enables to prevent contamination by toner wherein toner adhering to the sealing member contaminates a hand or clothes of a worker. However, this makes the configuration of the developing device complicated and large-sized, and the cost tends to be increased.

SUMMARY OF THE INVENTION

The present invention has been made in view of the above described conventional problems, and an object is to provide a developing device capable of performing an operation to remove a sealing member easily with simple configuration and realizing space saving without changing a conventional configuration of a device significantly, an image forming apparatus using the same, and a method for peeling off a sealing member of the developing device that enables to remove the sealing member easily without contaminating hands or clothes of a worker.

Followings show each configuration of a developing device, an image forming apparatus using the same, and a method for peeling of a sealing member of the developing device, according to the present invention to solve the above mentioned problems.

According to a first aspect of the present invention, a developing device includes: a developer reservoir having developer stored therein; a developing roller disposed adjacently to the developer reservoir for carrying the developer; a sealing member that is brought into close contact with the developer reservoir so as to cover a communication port in communication with inside of the developer reservoir, the communication port being formed as an opening at a position facing the developing roller in the developer reservoir; and a sealing passing member for passing the sealing member peeled off the developer reservoir, wherein the sealing member is peeled off the developer reservoir to open the communication port, and the sealing passing member has an opening with an approximately elliptical shape, through which the sealing member passes.

Furthermore, according to a second aspect of the present invention, in the first aspect of the developing device, the sealing passing member is preferably formed of a tapered shape having smaller in inner diameter toward downstream side in a peeling direction of the sealing member.

Furthermore, according to a third aspect of the present invention, in the first or second aspect, the developing device is configured so as to perform a detachment operation to a device to be mounted along an axial direction of the developing roller, wherein the sealing passing member is preferably provided in a near side in a mounting direction of the developing device.

Furthermore, according to a fourth aspect of the present invention, in any one of first through third aspects of the developing device, the sealing member is preferably formed with a thickness of not less than 0.075 mm and not more than 0.133 mm.

Furthermore, according to a fifth aspect of the present invention, in any one of first through fourth aspects of the developing device, the sealing member is preferably formed using polyethylene resin material.

Furthermore, according to a sixth aspect of the present invention, in any one of first through fifth aspects, the developing device is characterized in that the developing roller is preferably disposed above the developer reservoir.

Furthermore, the image forming apparatus includes any one of developing devices of first to sixth aspects for transferring a developer image formed on a surface of an electrostatic latent image carrier to a transfer medium by electrophotography to output an image.

Furthermore, a method for peeling off a sealing member of a developing device according to the present invention, includes a developer reservoir having developer stored therein; a developing roller disposed adjacently to the developer reservoir for carrying the developer; and a sealing member that is brought into close contact with the developer reservoir so as to cover a communication port in communication with inside of the developer reservoir, the communication port being formed as an opening at a position facing the developing roller in the developer reservoir, wherein the sealing member is peeled off the developer reservoir to open the communication port, comprising: a step of peeling off the sealing member along an axial direction of the developing roller; and a step of curling the sealing member along a width direction of the sealing member in an approximately vertical direction with respect to the peeling direction.

According to the first aspect of the present invention, in peeling off to remove the sealing member before a development operation, when the peeled sealing member passes through the sealing passing member, the sealing member is curled along a width direction by an opening with an approximately elliptical shape to curl a surface to which developer is adhered so as not to be exposed to an exterior side, thus making it possible to open the communication port without contaminating hands or clothes of a worker.

Furthermore, according to the first aspect of the present invention, the above mentioned effect can be achieved just by providing the sealing passing member, thus making it possible to realize the developing device with simple configuration and space saving. Accordingly, it is also possible to configure a device to which the developing device according to the present invention is mounted with space saving configuration.

Furthermore, according to the second aspect of the present invention, it is possible to gradually curl a surface of the sealing member to which developer is adhered to curl reliably. It is also possible to configure with simple structure to thereby provide with low cost.

Furthermore, according to the third aspect of the present invention, it is possible to pull out the sealing member in a state where the developing device is set in a device main body so that a pulling-out operation can be performed in a stable state.

Furthermore, according to the fourth aspect of the present invention, it is possible to secure sealing strength and folding performance.

Furthermore, according to the fifth aspect of the present invention, the sealing member does not react with a gluey agent for adhering the sealing member and has an appropriate strength, thus making it possible to peel off easily.

Furthermore, according to the sixth aspect of the present invention, even when developer is leaked from the sealing member, the developing roller is less likely to carry the developer, thus not contaminating surroundings with the developer.

Furthermore, according to the image forming apparatus of the present invention, before the image forming apparatus is operated after the developer is replaced, when the sealing member is peeled off the developer reservoir, the peeled sealing member passes through the sealing passing member to thereby curl the sealing member along the width direction through the opening with an approximately elliptical shape so that a surface to which developer is adhered is not exposed to an exterior side. As a result, it is possible to open the communication port of the developer reservoir without contaminating hands or clothes of a worker.

Furthermore, according to the method for peeling off the sealing member of the developing device of the present invention, it is possible to perform operation of replacing the developing device without contaminating hands or clothes of a worker by the developer.

DESCRIPTION OF THE PREFERRED EMBODIMENTS

The preferred embodiments of the present invention will hereinafter be described with reference to the drawings.

Figure 1:
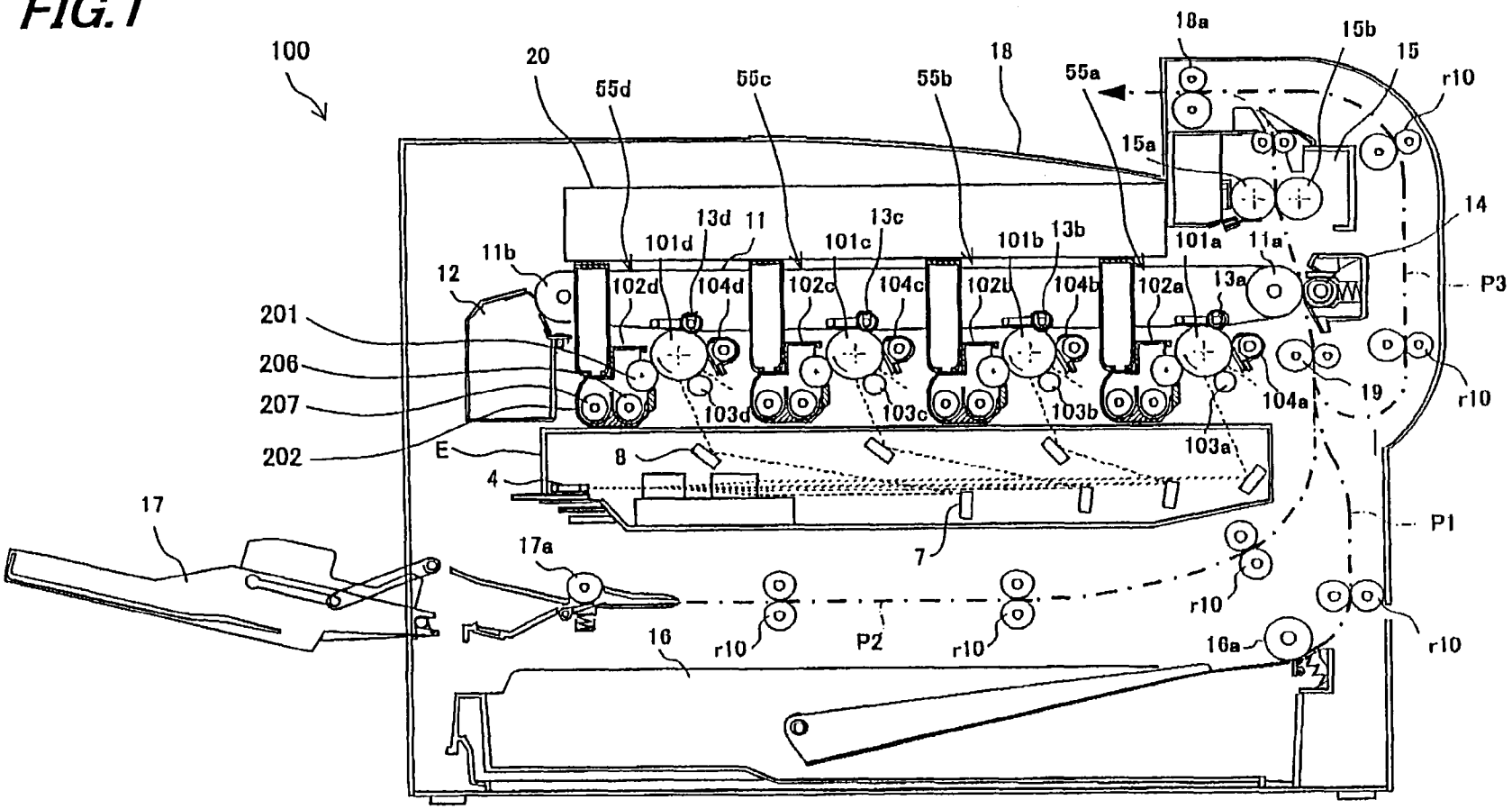
FIG. 1 is an illustrative view showing the configuration of an image forming apparatus according to an embodiment of the present invention.
Figure 2:
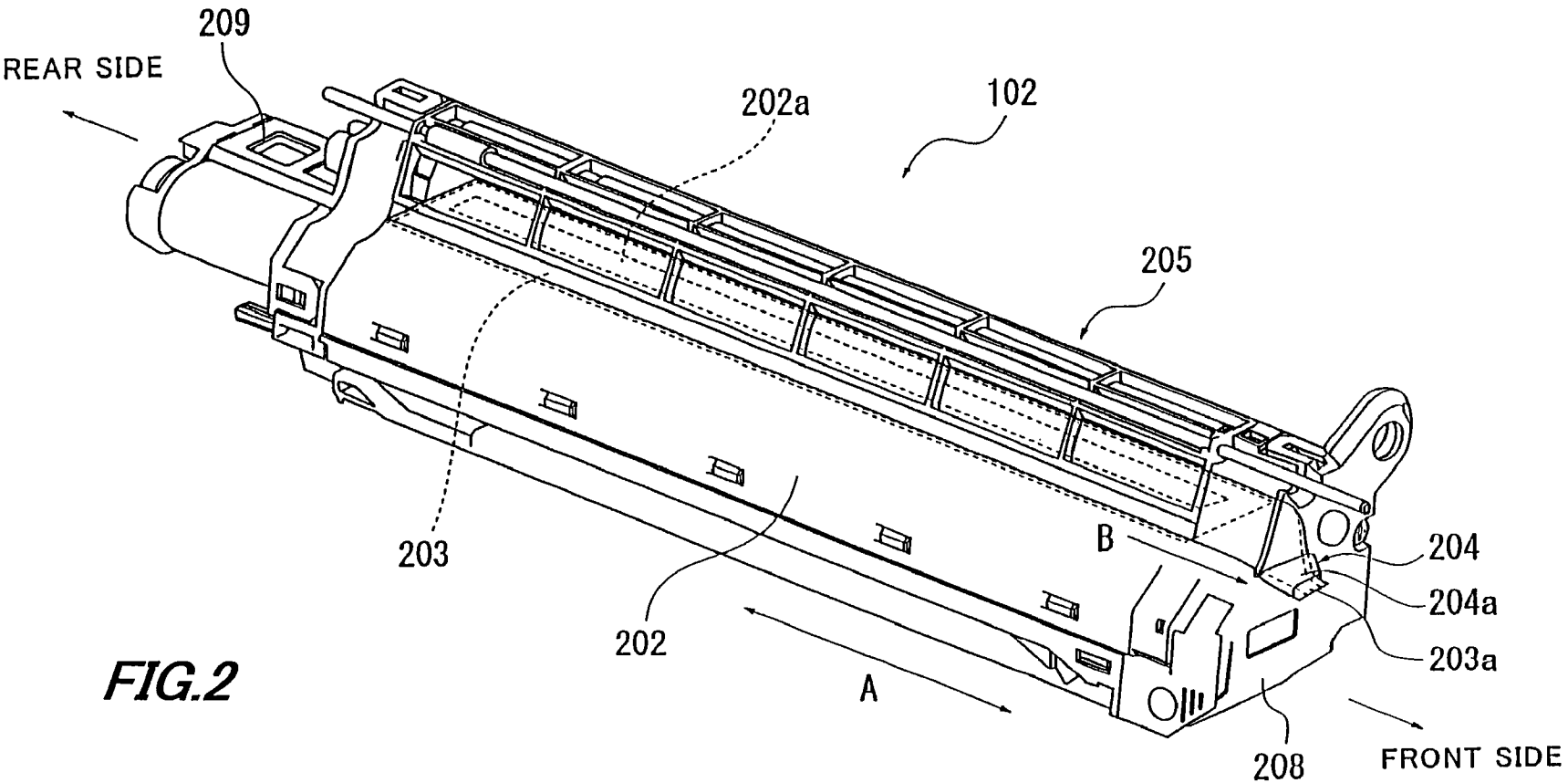
FIG. 2 is an illustrative view showing the configuration of a developing device mounted to the image forming apparatus.

FIG. 1 is an illustrative view showing the configuration of an image forming apparatus according to an embodiment of the present invention and FIG. 2 is an illustrative view showing the configuration of a developing device mounted to the image forming apparatus.

As shown in FIGS. 1 and 2, an image forming apparatus 100 according to the present embodiment includes a developing device 102 which is provided with a developer portion (developer reservoir) 202 for storing developer therein; a developing roller 201 that is disposed adjacently to the developer portion 202 for carrying developer; and a sealing member 203 that is brought into close contact so as to cover a communication port 202*a* which is formed as an opening at a position opposing to the developing roller 201 of the developer portion 202 and is in communication with inside of the developer portion 202, wherein the sealing member 203 is peeled off the developer portion 202 to open the communication port 202*a*, and in the image forming apparatus 100 for transferring a developer image formed on a surface of a photoreceptor drum 101 to a transfer medium by electrophotography to thereby output an image, the configuration of the developing device according to the present invention is employed as the developing device 102.

First, the entire configuration of the image forming apparatus 100 according to the present embodiment will be described.

The image forming apparatus 100 according to the present embodiment forms a color or monochromatic image as a visible image on a predetermined sheet (recording paper) based on image data included in an input command of image data or the like transmitted from outside through a communication network and the like.

The image forming apparatus 100 includes, as shown in FIG. 1, an exposure unit E, photoreceptor drums 101 (101*a* to 101*d*) corresponding to an image carrier having a latent image formed thereon by the exposure unit E, developing devices (developing units) 102 (102*a* to 102*d*), charging rollers 103 (103*a* to 103*d*), cleaning units 104 (104*a* to 104*d*), an intermediate transfer belt 11, primary transfer rollers 13 (13*a* to 13*d*), a secondary transfer roller 14, a fixing device 15, paper feed paths P1, P2, and P3, a paper feeding cassette 16, a manual paper feed tray 17, a paper output tray 18, a toner cartridge unit 20, and the like.

A visible image of image data of a color image treated in the image forming apparatus 100 is formed in image forming portions 55 (55*a* to 55*d*) using image data of a corresponding one of four colors of black (K), cyan (C), magenta (M), and yellow (Y). This corresponds to a color image using each color.

Each four pieces of developing devices (102*a* to 102*d*), photoreceptor drums 101 (101*a* to 101*d*), charging rollers 103 (103*a* to 103*d*), cleaning units 104 (104*a* to 104*d*) are provided, respectively, so as to form four kinds of latent images corresponding to each color.

The respective image forming portions 55*a* to 55*d* are similar to one another in configuration, and, for example, the image forming portion 55*a* for black color is configured of the photoreceptor drum 101*a*, the developing device 102*a*, the charging roller 103*a*, the transfer roller 13*a*, the cleaning unit 104*a*, and the like. The image forming portions 55*a* to 55*d* are arranged, in alignment with one another, along a movement direction (sub scanning direction) of the intermediate transfer belt 11.

Note that, the numerals a, b, c, and d correspond to black, cyan, magenta, and yellow, respectively, and four image stations are formed by each means distinguished by these numerals.

The exposure unit E as an exposure device includes a semiconductor laser (not shown), a polygon mirror 4, a first reflection mirror 7, a second reflection mirror 8, and the like, and irradiates each of the photoreceptor drums 101*a* to 101*d* with light beam such as laser beam modulated based on image data of each color of black, cyan, magenta, and yellow.

In the present embodiment, although the exposure unit E employs a method using a laser scanning unit (LSU) having a laser irradiation portion and reflection mirrors therein, for example, a method using an EL or LED writing head in which light emitting elements are arranged in an array may be used.

An electrostatic latent image according to the image data of each of black, cyan, magenta, and yellow is formed on each of the photoreceptor drums 101*a* to 101*d*.

The photoreceptor drums 101 disposed above the exposure unit E is an image carrier having an approximately cylindrical shape and is controlled so as to rotate in a predetermined direction by driving means and control means (not shown).

Furthermore, the photoreceptor drum 101 has a photoconductive layer formed on a substrate. For example, with a metal drum made of aluminum or the like as the substrate, a thin photoconductive layer, including amorphous silicon (a-Si), selenium (Se), and an organic photo conductor (OPC), is disposed on an outer circumferential surface of the substrate. Note that, the configuration of the photoreceptor drums 101 is not limited to the above described configuration.

The charging rollers 103 are contact-type chargers for uniformly charging surfaces of the photoreceptor drums 101 at a predetermined electric potential. In the present embodiment, as shown in FIG. 1, although the contact-type and roller-type charging rollers 103 are used as a charger, charger-type or brush-type chargers may be used alternatively instead of the charging rollers 103.

The developing devices 102 supply toner to the surfaces of the photoreceptor drums 101 bearing electrostatic latent images to develop the electrostatic latent images into toner images. Each of the developing devices 102*a* to 102*d* stores therein each color of black, cyan, magenta, and yellow toner, and visualizes each color of the electrostatic latent images formed on the respective photoreceptor drums 101*a* to 101*d* into each color of black, cyan, magenta, and yellow toner images.

The cleaning units 104 remove and collect residual toner on the surfaces of the photoreceptor drums 101 after development and transfer operation using lubricant or the like.

The intermediate transfer belt 11 is disposed above the photoreceptor drums 101 and is formed of an endless film of about 100 μm to 150 μm thickness. The intermediate transfer belt 11 is laid between an intermediate transfer belt driving roller 11*a* and an intermediate transfer belt driven roller 11*b* to form a loop-shaped movement path.

An outer circumferential surface of the intermediate transfer belt 11 faces the photoreceptor drum 101*d*, the photoreceptor drum 101*c*, the photoreceptor drum 101*b*, and the photoreceptor drum 101*a*, in that order.

The primary transfer rollers 13*a* to 13*d* are disposed opposite to the photoreceptor drums 101*a* to 101*d*, respectively, across the intermediate transfer belt 11. The intermediate belt 11 faces the drums 101*a* to 101*d* at respective primary transfer positions.

To each of the primary transfer rollers 13*a* to 13*d*, a primary transfer bias having a polarity opposite to a charging polarity of toner is applied at constant voltage control in order to transfer a toner image born on each of the surfaces of the photoreceptor drums 101*a* to 101*d* to the intermediate transfer belt 11. Thereby, the toner images of each color formed on the photoreceptor drums 101 (101*a* to 101*d*) are sequentially superimposed and transferred to the outer circumferential surface of the intermediate belt 11, so that a full-color toner image is formed on the outer circumferential surface of the intermediate transfer belt 11.

However, when image data of only a part of the colors of yellow, magenta, cyan, and black is input, an electrostatic latent image and a toner image are formed only on a part of the photoreceptor drums 101 corresponding to the input color of image data. For example, in monochromatic image formation, an electrostatic latent image and a toner image are formed only on the photoreceptor drum 101*a* corresponding to the color of black, and only a black toner image is transferred to the outer circumferential surface of the intermediate transfer belt 11.

Moreover, each of the primary transfer rollers 13*a* to 13*d* has a shaft of metal (for example, stainless steel) having a diameter of 8 to 10 mm, and the surface of the shaft is coated with conductive elastic material (for example, EPDM, urethane foam or the like) so as to apply a high voltage uniformly to the intermediate transfer belt 11 through the conductive elastic material. In the present embodiment, the primary transfer belt rollers 13*a* to 13*d* are used as a transfer electrode, but brush and the like can be also used.

Each of the toner images transferred to the outer circumferential surface of the intermediate transfer belt 11 at each of the primary transfer positions is conveyed to a secondary transfer position where the intermediate transfer belt 11 faces the secondary transfer roller 14 by the rotation of the intermediate transfer belt 11.

In image formation, the secondary transfer roller 14 is pressed at a predetermined nip pressure against the outer circumferential surface of the intermediate transfer belt 11 whose inner circumferential surface is in contact with a circumferential surface of the intermediate transfer belt driving roller 11*a*. In order to produce a constant nip pressure, either secondary transfer roller 14 or intermediate transfer belt driving roller 11*a* is formed of hard material such as metal or the like while the other roller is formed of soft material such as an elastic roller (an elastic rubber roller, a foamed resin roller, or the like).

When a sheet fed from either paper feeding cassette 16 or the manual paper feed tray 17 passes between the secondary transfer roller 14 and the intermediate transfer belt 11, a high voltage (+) having a polarity opposite to a charging polarity (−) of toner is applied to the secondary transfer roller 14.

In this way, each of the electrostatic latent images on the photoreceptor drums 101 (101*a* to 101*d*) is visualized with toner corresponding to each color to be a toner image, and the toner image is laminated on the intermediate transfer belt 11.

Thereafter, the laminated toner image is moved to a contact position of the conveyed paper and the intermediate transfer belt 11 by rotation of the intermediate transfer belt 11, and by the secondary transfer roller 14 disposed at that position, the toner image is transferred to the paper from the outer circumferential surface of the intermediate transfer belt 11.

Since the toner adhering to the intermediate transfer belt 11 when the intermediate transfer belt 11 comes in contact with photoreceptor drums 101, or the toner which has not been transferred and remains on the intermediate transfer belt 11 when the toner image is transferred to the paper from the intermediate transfer belt 11, would cause color mixing of toner at the next operation, it is removed and collected by an intermediate transfer belt cleaning unit 12.

The intermediate transfer belt cleaning unit 12 includes, for example, a cleaning blade as a cleaning member in contact with the intermediate transfer belt 11. A part of the intermediate transfer belt 11 in contact with the cleaning blade is supported from a rear side by the intermediate transfer belt driven roller 11*b*.

The paper having the toner image transferred thereto as a visible image is led to the fixing device 15 including a heating roller 15*a* and a pressing roller 15*b* and passes between the heating roller 15*a* and the pressing roller 15*b* to be applied with heating and pressing process. The toner image to be a visible image is thus firmly fixed to the surface of the paper. The sheet with the fixed toner image is output onto the paper output tray 18 by paper output rollers 18*a*.

The image forming apparatus 100 has a paper feed path P1 extending in an approximately vertical direction for feeding a paper stored in the paper feeding cassette 16, through a gap between the secondary transfer roller 14 and the intermediate transfer belt 11 and through the fixing device 15, to the paper output tray 18.

On the paper feed path P1 provided are a pick-up roller 16*a* for picking up and feeding the paper in the paper feeding cassette 16 to the paper feed path P1 one by one, feed rollers r10 for feeding the paper, that has been picked up and fed, upwardly, a registration roller 19 for guiding the fed paper to a gap between the secondary transfer roller 14 and the intermediate transfer belt 11 at a predetermined timing, and a paper output roller 18*a* for outputting the paper on the paper output tray 18.

The image forming apparatus 100 also has a paper feed path P2 which extends from the manual paper feed tray 17 to the registration roller 19 and which is provided with a pick-up roller 17*a* and the feed rollers r10. Also provided is a paper feed path P3 extending from the paper output roller 18*a* to upstream of the registration roller 19 on the paper feed path P1.

The paper output roller 18*a* is provided so as to be rotatable in both forward and backward directions, and in single-side image formation for forming an image on a single side of a paper, and in image formation on a second side of a paper in double-side image formation for forming an image on double sides of the paper, the paper output roller 18*a* is driven in the forward direction in order to output the paper onto the paper output tray 18.

On the other hand, in image formation on a first side of the paper in the double-side image formation, the paper output roller 18*a* is driven in the forward direction until a tail end of the paper passes through the fixing device 15, and thereafter is driven in the backward direction with the tail end of the sheet held therebetween to lead the paper into the paper feed path P3. Thus, the sheet having an image formed only on the single side thereof in the double-side image formation is led into the paper feed path P1 with the first and second sides and leading and tail ends reversed.

The registration roller 19 leads the paper fed either from the paper feeding cassette 16 or the manual paper feed tray 17, or through the paper feed path P3, to a gap between the secondary transfer roller 14 and the intermediate transfer belt 11 in synchronized timing with the rotation of the intermediate transfer belt 11. Therefore, at the time the photoreceptor drums 101 and the intermediate transfer belt 11 are activated, the registration roller 19 stops the rotation, and the paper fed or conveyed before the rotation of the intermediate transfer belt 11 stops movement thereof in the paper feed path P1, with a leading end thereof brought into contact with the registration roller 19.

Then, when the leading end of the paper and a leading end of the toner image formed on the intermediate transfer belt 11 face each other in the press-contact position of the secondary transfer roller 14 and the intermediate transfer belt 11, the registration roller 19 is activated to rotate.

Note that, in all of the image forming portions 55*a* to 55*d*, in the full-color image formation for forming an image, the primary transfer rollers 13*a* to 13*d* press the intermediate transfer belt 11 against all of the photoreceptor drums 101*a* to 101*d*.

On the other hand, only in the image forming portion 55*a*, in the monochromatic image formation for forming an image, only the primary transfer roller 13*a* presses the intermediate transfer belt 11 against the photoreceptor drum 101*a*.

Next, the configuration of the characteristic developing device 102 according to the present embodiment will be described in detail with reference to the drawings.

Figure 3:
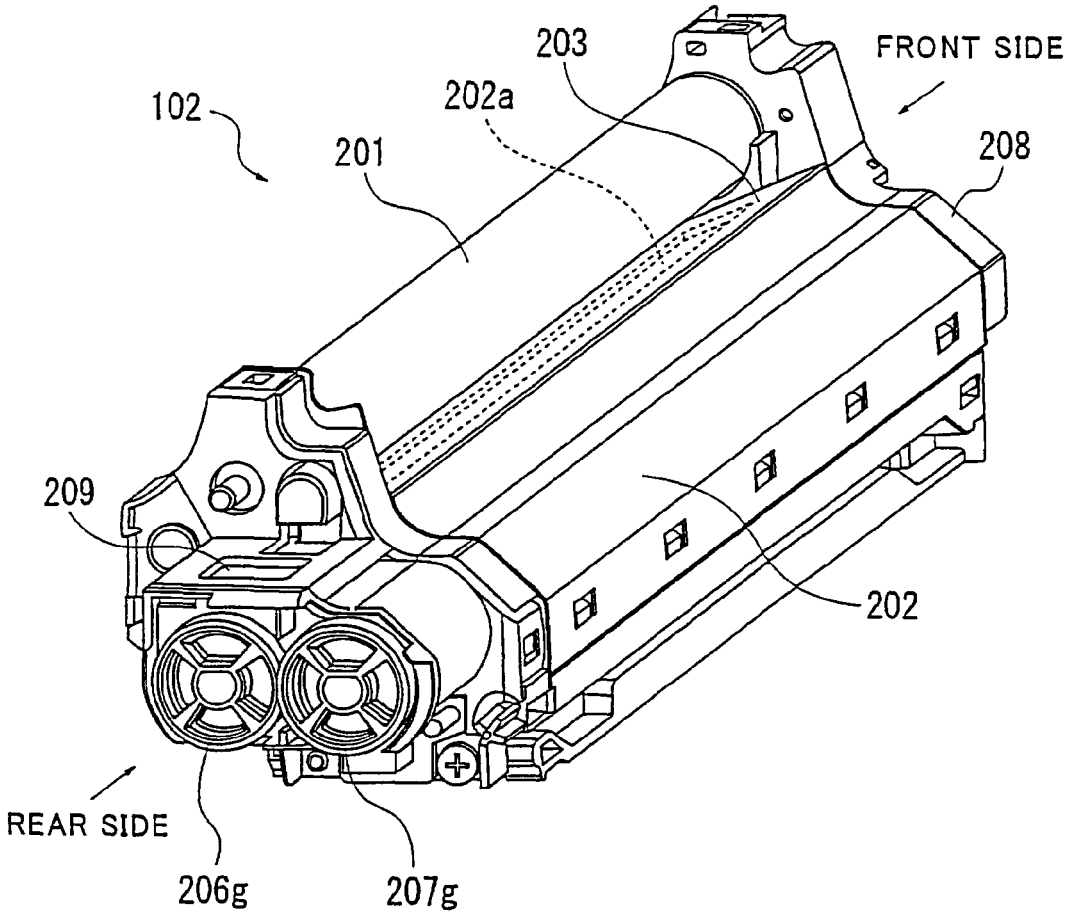
FIG. 3 is a perspective view showing the configuration where an upper cover of the developing device is removed.
Figure 4:
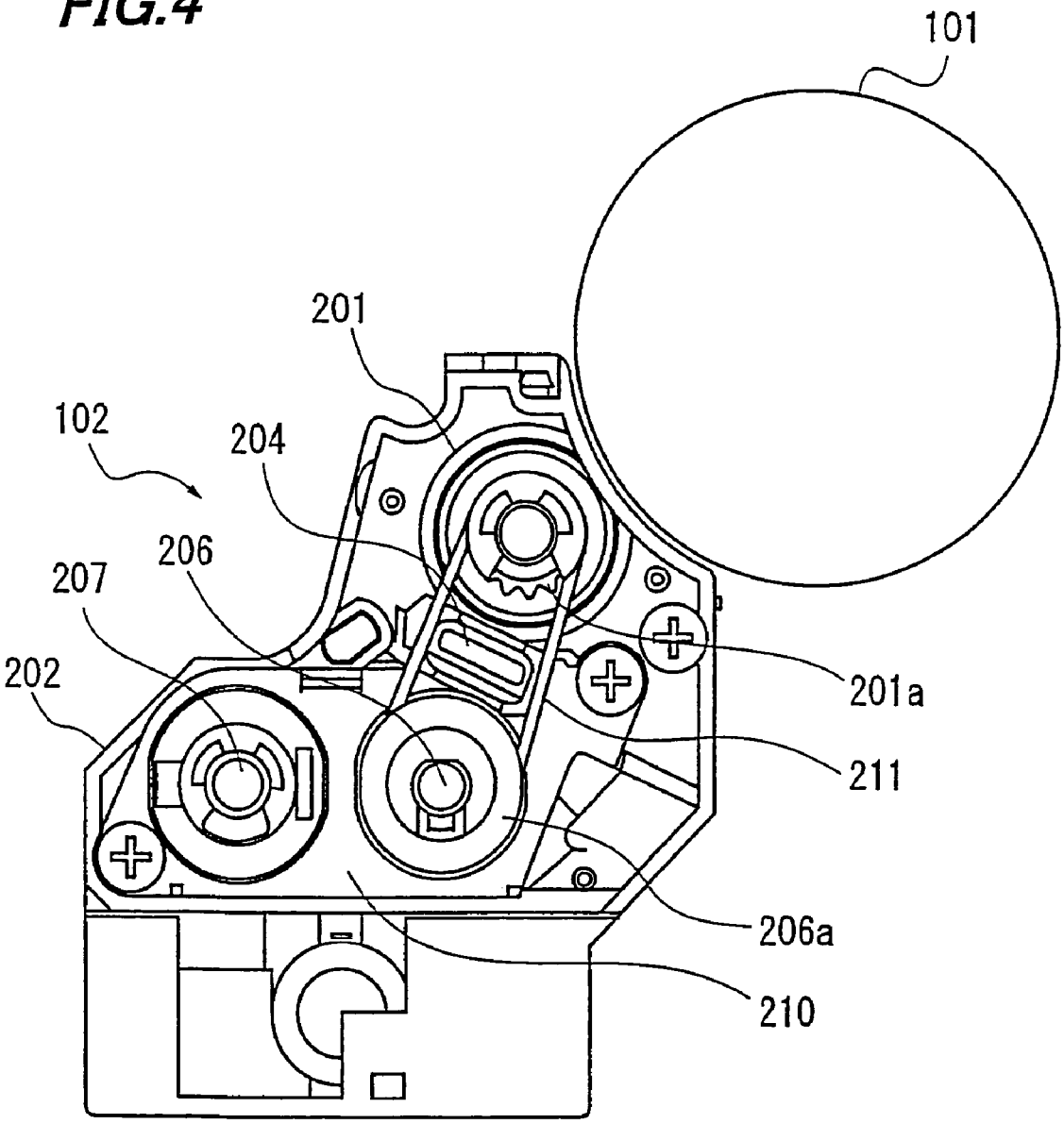
FIG. 4 is an illustrative view showing the configuration where a front cover of the developing device is removed.
Figure 5A:
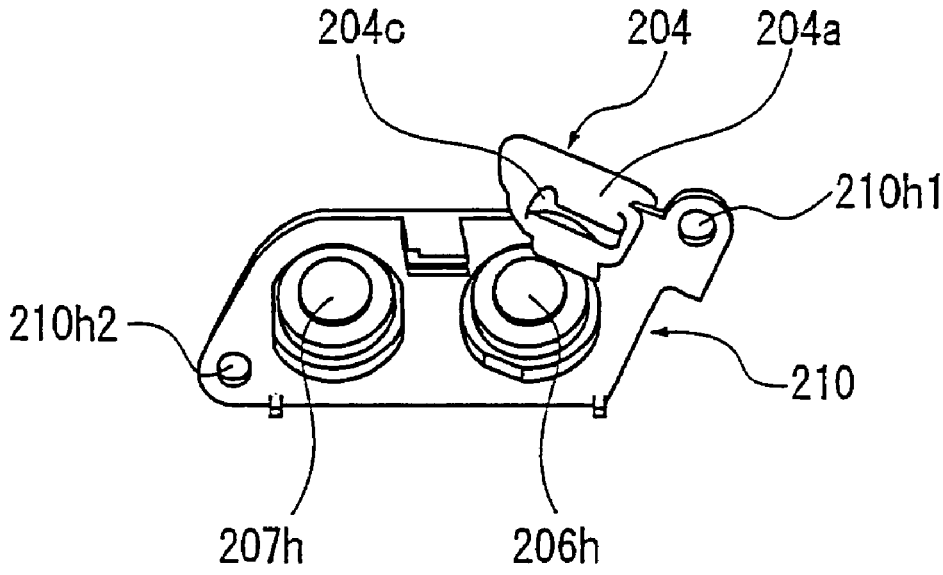
FIG. 5A is a perspective view when viewed from a front side showing the configuration of a sealing passing member constituting the developing device and FIG. 5B is a perspective view when viewed from a rear side showing the configuration of the sealing passing member.
Figure 5B:
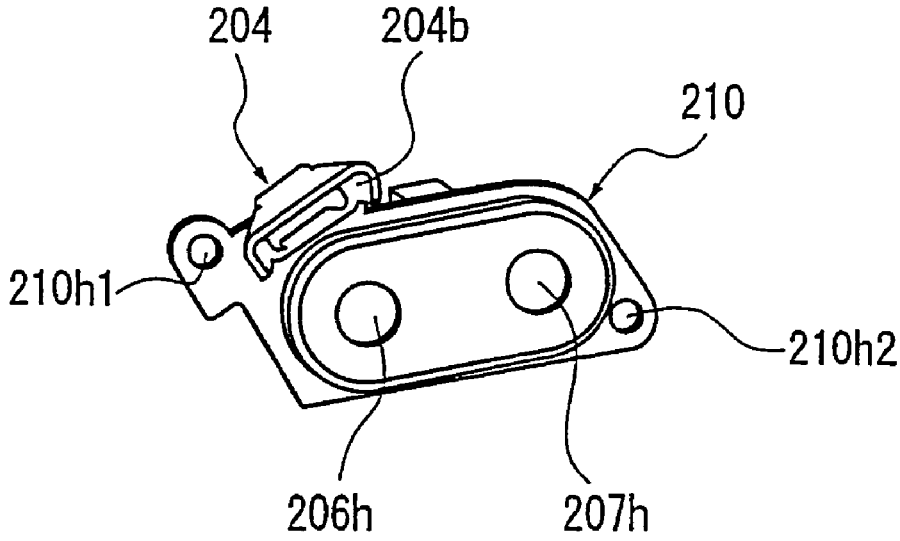

FIG. 3 is a perspective view showing the configuration where an upper cover of the developing device is removed, FIG. 4 is an illustrative view showing the configuration where a front cover of the developing device is removed, FIG. 5A is a perspective view when viewed from a front side showing the configuration of a sealing passing member constituting the developing device, and FIG. 5B is a perspective view when viewed from a rear side showing the configuration of the sealing passing member.

The developing device 102 according to the present embodiment includes, as shown in FIGS. 1 to 3, a developer portion 202 having developer stored therein, and two agitating screws 206 and 207 for agitating and conveying developer into the developer portion 202 so as to supply developer to the developing roller 201 disposed above the developer portion 202.

As shown in FIGS. 3 and 4, in the developing device 102 before being mounted to the image forming apparatus 100, the sealing member 203 for partitioning between the developer portion 202 and the developing roller 201 disposed above the developer portion 202 is attached approximately in a horizontal direction to the developer portion 202. That is, the communication port 202*a* formed in the developer portion 202 is being sealed by the sealing member 203.

As shown in FIG. 2, the developing device 102 configured in this way is configured so as to be detachable to the image forming apparatus 100 by sliding along a longitudinal direction of the developing device 102, that is, along an axial direction (direction indicated by the arrow A (FIG. 2)) of the developing roller 201.

In the developing device 102 of the present embodiment, a travel direction side where the developing device 102 is slid when the developing device 102 is mounted to the image forming apparatus 100 is a rear side (left side in FIG. 2) and a near side of the developing device 102 main body is a front side (right side in FIG. 2).

The developer portion 202 is, as shown in FIGS. 2 and 3, formed to be long in the axial direction of the developing roller 201, where a toner supply portion 209 is projectively formed in the rear side and toner is supplied into the developer portion 202 through the toner supply portion 209. Specifically, as shown in FIG. 1, toner is supplied to the developer portion 202 from the toner cartridge unit 20 disposed above the developer portion 202 in the rear side of the developer portion 202.

Furthermore, in the rear side of the developer portion 202, as shown in FIG. 3, each of driving gears 206*g* and 207*g* for driving to rotate the agitating screws 206 and 207 (FIG. 1) disposed in the developer portion 202 is disposed.

As shown in FIGS. 2 and 3, above the developer portion 202, the developing roller 201 is disposed at a position facing the agitating screw 206 within the developer portion 202, and an upper cover 205 is provided so as to cover an outer circumferential surface of the developing roller 201 along the axial direction A of the developing roller 201.

As shown in FIG. 3, in an upper part of the developer portion 202, the communication port 202*a* for enabling to supply developer to the developing roller 201 from the agitating screw 206 is formed so as to open at a position where the agitating screw 206 within the developer portion 202 and the developing roller 201 outside the developer portion 202 face to each other through the upper part.

In the front side of the developer portion 202, as shown in FIG. 4, a timing pulleys 201*a* and 206*a* and a timing belt (driving belt) 211 are disposed as driving transmission means for transmitting driving force of the agitating screw 206 to the developing roller 201. With the driving transmission means, the developing roller 201 is driven to rotate using rotation of the agitating screw 206.

Furthermore, in the front side of the developer portion 202, as shown in FIGS. 4, 5A, and 5B, a shaft support member 210 for pivotally supporting each one end of the two agitating screws 206 and 207 is disposed. Moreover, as shown in FIG. 2, a front cover 208 for covering the shaft support member 210, the driving transmission means and the like is disposed.

As shown in FIGS. 5A and 5B, the shaft support member 210 is formed with through holes 206*h* and 207*h* through which each one end of agitating shafts of the two agitating screws 206 and 207 pierces, and attachment holes 210*h*1 and 210*h*2 for fixing the shaft support member 210 to the developer portion 202.

Furthermore, as shown in FIGS. 2 and 4, the shaft support member 210 is integrally provided so that a sealing passing member 204 for passing the sealing member 203 protrudes to the front side at a position between the developing roller 201 and the agitating screw 207 and on an extension line in the longitudinal direction of the sealing member 203 attached to the developer portion 202.

The sealing passing member 204 is, as shown in FIG. 2, projectively disposed in the front side passing through the front cover 208 in a state where the front cover 208 is mounted in the front side of the developer portion 202. Moreover, it is provided so that one end 203*a* of the sealing member 203 is exposed from a leading end 204*a* of the sealing passing member 204.

That is, the one end 203*a* of the sealing member 203, which is exposed from the leading end 204*a* of the sealing passing member 204, is pulled toward right (direction indicated by the arrow B) in FIG. 2 so that the sealing member 203 is peeled off the developer portion 202 and the peeled sealing member 203 passes through the sealing passing member 204.

Furthermore, as shown in FIG. 2, the sealing passing member 204 has an inner part through which the sealing member 203 passes, which is formed of a tapered shape having smaller in inner diameter toward downstream side in a peeling direction (direction indicated by the arrow B) of the sealing member 203, that is, toward the leading end 204*a*. That is, as shown in FIGS. 5A and 5B, the inner shape is formed so that an outlet-side opening 204*c* of the leading end 204*a* is narrower than an inlet-side opening 204*b* of the sealing passing member 204. A part where the sealing member 203 of the sealing member 203 passes is formed as an opening with an approximately elliptical shape.

The inlet-side opening 204*b* has a width wider than a maximum width of the sealing member 203. On the other hand, the outlet-side opening 204*c* has a width wider than that of the one end 203*a* of the sealing member 203 and narrower than the maximum width of the sealing member 203.

Next, a shape of the characteristic sealing member 203 according to the present embodiment will be described with reference to the drawings.

Figure 6A:
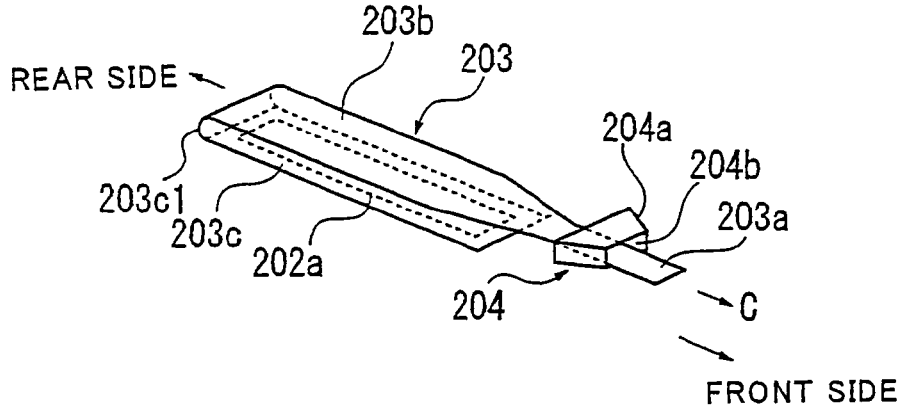
FIG. 6A is an illustrative view showing a shape of a sealing member and an arrangement state of the sealing passing member according to the present embodiment.
Figure 6B:
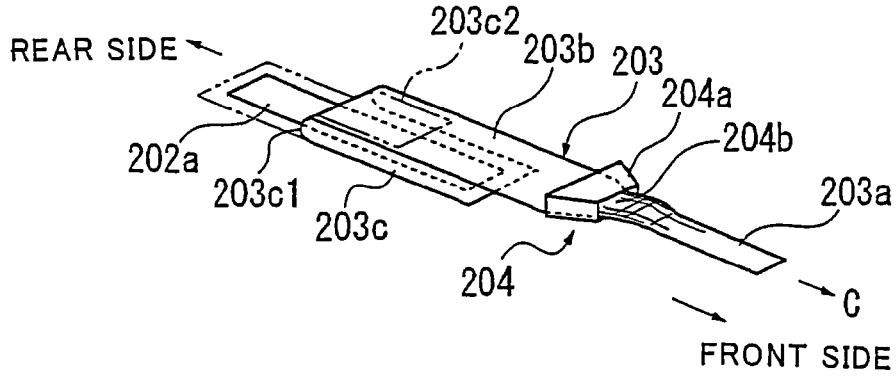
FIG. 6B is an illustrative view showing an initial state in an operation to peel off the sealing member through the sealing passing member.
Figure 6C:
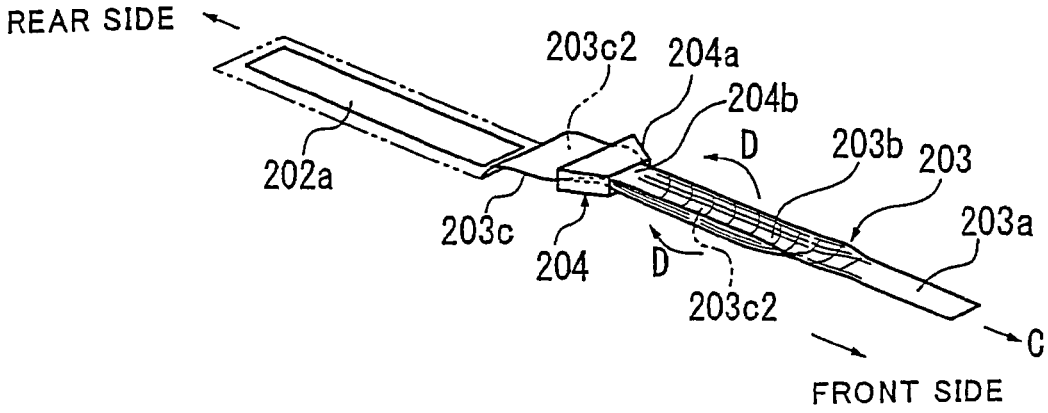
FIG. 6C is an illustrative view showing a state where the sealing member is further peeled off.

FIG. 6A is an illustrative view showing a shape of the sealing member and an arrangement state of the sealing passing member according to the present embodiment, FIG. 6B is an illustrative view showing an initial state in an operation to peel off the sealing member through the sealing passing member, and FIG. 6C is an illustrative view showing a state where the sealing member is further peeled off.

As shown in FIG. 6A, the sealing member 203 has both end edges in a width direction formed approximately in parallel so as to cover the communication port 202*a* at a part attached to the developer portion 202 (attachment portion 203*c*) and becomes narrower toward the front side, where the one end 203*a* has a width narrower than that of the outlet-side opening 204*c* of the leading end 204*a* in the sealing passing member 204 so as to be able to pass through.

Specifically, the sealing member 203 is attached to the developer portion 202 within a range of covering the communication port 202*a* of the developer portion 202 along the longitudinal direction of the developer portion 202 (attachment portion 203*c*) and is folded from the rear side to the front side (a fold portion 203*b*) so that the one end 203*a* is exposed from the leading end 204*a* of the sealing passing member 204 in the front side.

A part continuing from the one end portion 203*a* to the fold portion 203*b* is formed so as to be continuously wider from the one end portion 203*a* to the fold portion 203*b*.

The attachment portion 203*c* has an adhesive surface 203*c*2 to which an adhesive or a gluey agent is applied on a surface facing the developer portion 202.

That is, in the present embodiment, the one end 203*a* of the sealing member 203 is pulled toward the front side to peel the sealing member 203 off the developer portion 202 so that the communication port 202*a* is opened from the rear side to the front side.

The sealing member 203 is formed like a sheet whose thickness is not less than 0.075 mm and not more than 0.133 mm, using polyethylene resin material.

Specifically, when the thickness of the sealing member 203 exceeds 0.133 mm, rigidity of the sealing member 203 itself becomes too strong, that is, stiffness becomes too high to make it difficult to fold. Moreover, deficiency of strength is caused when the thickness is less than 0.075 mm, and there is a risk that the sealing member 203 is broken in peeling. Accordingly, the sealing member 203 is set to be having a thickness not less than 0.075 mm and not more than 0.133 mm.

Furthermore, by using a so-called heat sealing member using a polyethylene resin material as the member, the sealing member 203 is less likely to be reacted with a gluey agent for adhering the sealing member 203 to the developer portion 202 and has an appropriate strength, thus showing such a property that, when tension is acted in the longitudinal direction, the width direction is reduced to be curled. Note that, as an example of the sealing member 203, polyethylene resin of LATA-90#EL60 (manufactured by Nihon Matai Co., Ltd.) with a thickness of 0.1 mm was used.

Next, an operation and action of peeling the sealing member 203 will be described with reference to the drawings.

When the sealing member 203 is removed from the developer portion 202, firstly, as shown in FIG. 6A, the one end 203*a* of the sealing member 203, which is exposed from the leading end 204*a* of the sealing passing member 204, is nipped and pulled toward the direction indicated by the arrow C.

When the one end 203*a* is pulled, as shown in FIG. 6B, the fold portion 203*b* continuing to the one end 203*a* is pulled so that the sealing member 203 is peeled off the developer portion 202 while folding the attachment portion 203*c* from a boundary portion 203*c*1 between the fold portion 203*b* and the attachment portion 203*c*.

Since the sealing passing member 204 is configured so that the width direction becomes narrower toward the leading end 204*a*, when tension is acted on both end edges more than a center part in the width direction, the sealing member 203 that is peeled off the attachment portion 203*c* to be pulled out through the sealing passing member 204 is pulled out from the sealing passing member 204 while the center part in the width direction of the sealing member 203 is being in recessed state downward in the drawing.

Furthermore, when the sealing member 203 is peeled off the developer portion 202 and the attachment portion 203*c* having a larger width is pulled out through the sealing passing member 204, as shown in FIG. 6C, the sealing member 203 becomes a greatly curled state where the both end edges in the width direction rolls the center part into the inside (the direction indicated by the arrow D), and further becomes a cylindrical shape where the adhesive surface 203*c*2 of the attachment portion 203*c* is rolled into the inside at a downstream side in a pulled-out direction of the sealing member 203.

In this way, the sealing member 203 peeled off the developer portion 202 is pulled out to the outside the developing device 102 in a state where the adhesive surface 203*c*2 is rolled into the inside. Then, the communication port 202*a* of the developer portion 202 is opened so that the developing device 102 can supply developer to the photoreceptor drums 101.

With the configuration as described above, according to the present embodiment, the sealing passing member 204 is provided in the developer portion 202 of the developing device 102 so that the sealing member 203 peeled off the developer portion 202 is pulled out to the outside the developing device 102 through the sealing passing member 204, thus making it possible to remove sealing member of the sealing member 203. As a result, it is possible to easily remove the sealing member 203 with saved space and without significantly changing the configuration of a conventional developing device. Furthermore, even when developer (including toner) in the developer portion 202 is adhered to the adhesive surface 203*c*2 of the removed sealing member 203, since the adhesive surface 203*c*2 is being rolled into the inside so that the adhesive surface 203*c*2 is not in contact with a worker or surrounding components, it is possible to easily perform work without contaminating a device or hands and clothes of a worker.

Furthermore, according to the present embodiment, the shaft support member 210 for supporting each one end of the agitating screws 206 and 207 is disposed in the front side of the developer portion 202 and this shaft support member 210 is integrally provided in the sealing passing member 204, thus making it possible to realize the simple configuration of a device with saved space and to easily remove the sealing member 203 from the front side.

Furthermore, according to the present embodiment, the sealing passing member 204 has an inner part through which the sealing member 203 passes, which is formed of a tapered shape having smaller in inner diameter toward downstream side in a peeling direction of the sealing member 203 (toward the leading end 204*a*), thus making it possible to effectively curl the sealing member 203 pulled out from the sealing passing member 204.

Furthermore, according to the present embodiment, the sealing member 203 is configured so as to be folded back to be peeled off, thus making it possible to peel off the sealing member 203 easily with effective peeling action.

Furthermore, the sealing member 203 has a part continuing from the one end portion 203*a* to the fold portion 203*b* formed so as to be continuously wider from the one end portion 203*a* to the fold portion 203*b*, thus making it possible to effectively curl the sealing member 203 pulled out from the sealing passing member 204.

Note that, in the present embodiment, the sealing passing member 204 has the opening, through which the sealing member 203 passes, with an approximately elliptical shape, but the configuration of the sealing passing member 204 is not limited thereto, for example, like curving with the adhesive surface 203*c*2 of the sealing member 203 faced inside, the configuration where a part facing a rear surface of the adhesive surface 203*c*2 is curled may be applied. By configuring in this way, it is possible to curl the sealing member 203 with the adhesive surface 203*c*2 thereof curled inside reliably.

In the above, the present invention will not be limited to above described embodiments and many alterations can be made to the above described embodiments within the scope of the present invention. That is, also an embodiment obtained by combining technical means varied within the scope of claims as appropriate will be included in the technical scope of the present invention For example, in above described embodiments, although a color image forming apparatus in which a plurality of developing devices are attached is applied to the present invention, the present invention is also applicable to an image forming apparatus in which a monochrome developing device is disposed.

What is claimed is:

1. An image forming apparatus for transferring a developer image formed on a surface of an electrostatic latent image carrier to a transfer medium by electrophotography to output an image, the image forming apparatus including a developing device comprising:

a developer reservoir having developer stored therein;

a developing roller disposed adjacently to the developer reservoir for carrying the developer; and a sealing member that is brought into close contact with the developer reservoir so as to cover a communication port in communication with inside of the developer reservoir, the communication port being formed as an opening by peeling off the sealing member, wherein the developing device is configured so as to be detachable to the image forming apparatus by sliding along a longitudinal direction of the developing roller, wherein the developer reservoir of the developing device is provided with an agitating screw, and a shaft support member pivotally supports the agitating screw and the developing roller at an opposite end of an attaching direction of the developing device, wherein the axial direction of the agitating screw is disposed horizontally while the developing roller is disposed above it, and a timing belt is disposed as a driving transmission means at the opposite end of the agitating screw and the developing roller, wherein the shaft support member is provided with a sealing passing member having an opening with an approximately elliptical shape, through which the peeled-off sealing member passes, wherein the opening of the sealing passing member is projectively disposed passing through the shaft support member along the longitudinal direction of the sealing member attached to the developing device and, when viewed from axial direction of the agitating screw, between the agitating screw and the developing roller and within an enclosure of the timing belt.

2. The image forming apparatus according to claim 1, wherein the opening of the sealing passing member is formed of a tapered shape having smaller inner diameter toward downstream side in a peeling direction of the sealing member.

3. The image forming apparatus according to claim 1, wherein the developing device is configured such that the agitating screw and the developing roller are disposed parallel to each other so as to perform a detachment operation to a device to be mounted along an axial direction of the developing roller, wherein the sealing passing member is provided in a near side in a mounting direction of the developing device.

4. The image forming apparatus according to claim 1, wherein the sealing member is formed with a thickness of not less than 0.075 mm and not more than 0.133 mm.

5. The image forming apparatus according to claim 1, wherein the sealing member is formed using polyethylene resin material.

6. The image forming apparatus according to claim 1, wherein the developing roller is disposed above the developer reservoir.

* * * * *